US007166957B2

(12) United States Patent
Bartch et al.

(10) Patent No.: US 7,166,957 B2
(45) Date of Patent: Jan. 23, 2007

(54) CRT HAVING A CONTRAST ENHANCING EXTERIOR COATING AND METHOD OF MANUFACTURING THE SAME

(75) Inventors: Donald Walter Bartch, York, PA (US); James Francis Edwards, Lancaster, PA (US)

(73) Assignee: Thomson Licensing, Boulogne-Billancourt (FR)

( * ) Notice: Subject to any disclaimer, the term of this patent is extended or adjusted under 35 U.S.C. 154(b) by 64 days.

(21) Appl. No.: 10/218,780

(22) Filed: Aug. 14, 2002

(65) Prior Publication Data

US 2004/0032200 A1 Feb. 19, 2004

(51) Int. Cl.
*H01J 31/00* (2006.01)

(52) U.S. Cl. ..... 313/479; 313/477 R

(58) Field of Classification Search ..... 313/477 R, 313/479

See application file for complete search history.

(56) References Cited

U.S. PATENT DOCUMENTS

| | | | | |
|---|---|---|---|---|
| 4,694,218 | A * | 9/1987 | Chao | 313/478 |
| 5,122,709 | A * | 6/1992 | Kawamura et al. | 313/479 |
| 5,291,097 | A * | 3/1994 | Kawamura et al. | 313/478 |
| 5,750,187 | A * | 5/1998 | Magnone et al. | 427/64 |
| 6,150,756 | A * | 11/2000 | Wakelkamp et al. | 313/479 |
| 6,284,306 | B1 * | 9/2001 | Oomen et al. | 427/64 |
| 6,323,592 | B1 * | 11/2001 | Takahashi et al. | 313/479 |
| 6,339,286 | B1 | 1/2002 | Kojima et al. | |
| 6,423,404 | B1 | 7/2002 | Ohtsuka et al. | |
| 2002/0113540 | A1 * | 8/2002 | Yu et al. | 313/479 |

FOREIGN PATENT DOCUMENTS

| | | | |
|---|---|---|---|
| CN | 1105479 | A | 7/1995 |
| CN | 1129351 | A | 8/1996 |
| EP | 0 538 937 | A1 * | 4/1993 |
| EP | 0758139 | A1 | 2/1997 |
| EP | 1020891 | A2 | 7/2000 |
| JP | 2-269178 | | 11/1990 |
| WO | WO99/63569 | | 12/1999 |

* cited by examiner

*Primary Examiner*—Ashok Patel
(74) *Attorney, Agent, or Firm*—Joseph J. Laks; Harvey D. Fried; Richard LaPeruta

(57) ABSTRACT

The invention is a cathode-ray tube (CRT) and method of manufacturing the CRT having a contrast enhancing coating on the exterior surface of the viewing faceplate. The contrast enhancing coating reduces the transmission of faceplate of the CRT by about 50%. The coating also yields gloss values in the range of 70 to 90. The manufacture comprises the steps of preparing an intermediate formulation containing a hydrolyzed organic silicate, diluting the intermediate formulation with an organic solvent and adding a contrast enhancing material to provide a final formulation, spraying the final formulation onto the faceplate to form the coating, heating the faceplate to cure the coating, and rinsing the coating, thereby forming a stable contrast enhancing coating on the faceplate.

8 Claims, 2 Drawing Sheets

CRT HAVING A CONTRAST ENHANCING EXTERIOR COATING AND METHOD OF MANUFACTURING THE SAME

This invention relates to a cathode-ray tube (CRT) and the manufacture of the CRT having a cost effective contrast enhancing coating.

BACKGROUND OF INVENTION

In the manufacture of CRTs, it is often desirable to have the effective faceplate transmission at about 40% to enhance the contrast of the displayed images. Essentially transmissions around 40% effectively reduce the light noise from ambient sources in the vicinity of the tube to help prevent the ambient sources from interfering with the quality of the displayed images. One means of making CRTs with such low transmission is to use dark glass; however, the manufacture of dark glass is more expensive than the light, high transmission glass. As such, the CRT industry has been utilizing neutral density faceplate coatings on faceplates to effectively decrease the transmission. This effort has proven to be more cost effective.

The recent trend is that CRT designers and manufacturers prefer, for a given size tube, that all faceplates start out as having a specific, high transmission. The reasoning is two fold. First, as alluded to above, such glass costs less because there is less tinting materials in the glass. The second reason relates to the fact that manufacturers often need to manufacture CRTs having several different transmissions within a given size. Thus, a manufacturer can simply tailor the transmission of the faceplate with appropriate contrast enhancing faceplate coatings to meet the varying faceplate transmission demands.

In U.S. Pat. No. 5,750,187, the key components of a contrast enhancing faceplate coating were lithium polysilicate and carbon particles. In specific examples in that patent, the faceplate transmission was decreased in the range of 19–37% with respect the uncoated faceplates, while the gloss of the coated faceplates was in the range of 56–70 as measured by a 60° gloss measuring technique. Although the capability of reducing the faceplate transmission with faceplate coatings is deemed important, it is likewise important in certain markets to have the capability to simultaneously retain high gloss values in a cost effective manner. Therefore, the CRT industry is challenged to produce low cost CRTs, wherein faceplates have a coating with high gloss values and significant transmission reducing properties. Specifically, the coating should be able to reduce the transmission of the faceplates by about 50% and simultaneously allow the faceplates to have gloss values around 70–90 as measured by a 60° gloss measuring technique.

SUMMARY OF INVENTION

The invention is a cathode-ray tube (CRT) and method of manufacturing the CRT having a contrast enhancing coating on the exterior surface of the viewing faceplate, wherein the contrast enhancing coating comprises a silicate binder and at least one contrast enhancing material. The method of making the CRT comprises the steps of hydrolyzing an organic silicate in a mixture of an alcohol, an acid and water to provide an intermediate formulation. The method further involves diluting the intermediate formulation with an organic solvent and adding contrast enhancing material to provide a final formulation. The method further includes spraying the final formulation onto the faceplate of the CRT to provide the contrast enhancing coating, heating the faceplate to cure the coating, and rinsing the coating.

Alternately an anti-static layer is applied before the contrast enhancing coating by spraying a formulation of an organic conductor and some hydrolyzed organic silicate onto the faceplate of the tube.

BRIEF DESCRIPTION OF THE DRAWING

The invention will now be described in greater detail, with reference to the accompanying drawings.

DETAILED DESCRIPTION OF THE PREFERRED EMBODIMENTS

Figure 1:
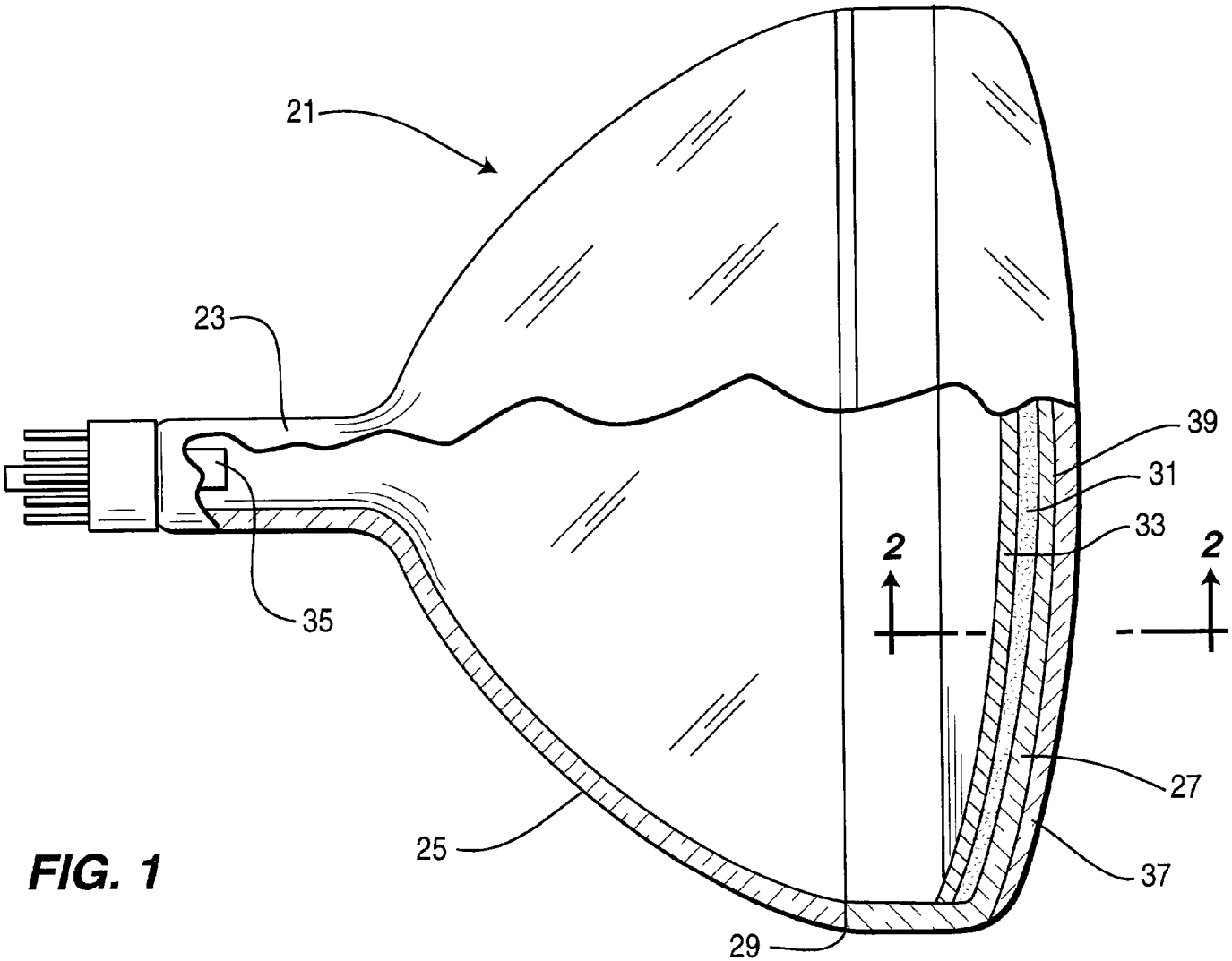
FIG. 1 is a partially broken-away longitudinal view of a CRT according to the present invention.
Figure 2:
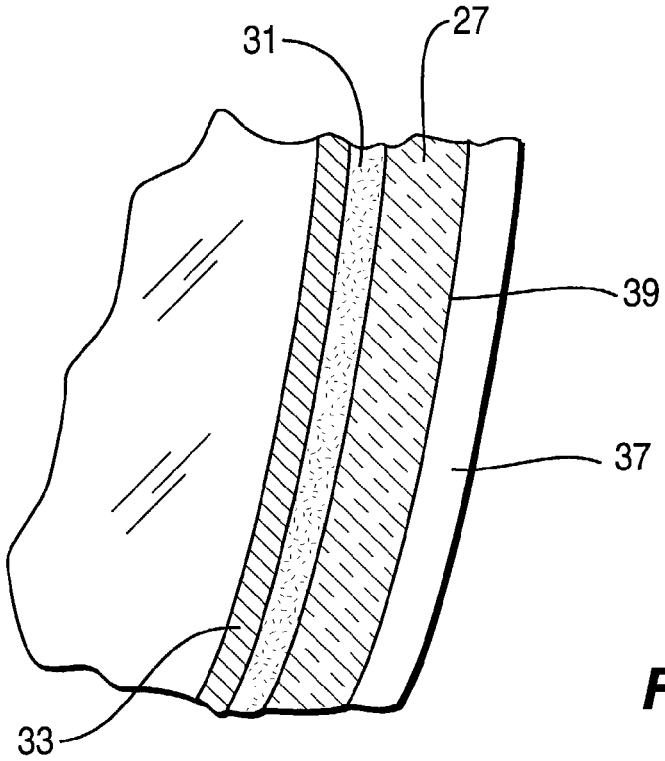
FIG. 2 is an enlarged sectional view through a fragment of the faceplate of the tube illustrated in FIG. 1, along section lines 2—2.

A CRT 21, illustrated in FIG. 1, includes an evacuated glass envelope having a neck section 23 integral with a funnel section 25. A faceplate 27 is joined to the funnel section 25 by a devitrified glass frit seal 29. A luminescent screen 31 of phosphor materials is applied to an interior surface of the faceplate 27. A light-reflecting metal film 33 of, for example, aluminum, is deposited on the luminescent screen 31, as shown in detail in FIG. 2. The luminescent screen 31, when scanned by an electron beam from a gun 35, is capable of producing a luminescent image which may be viewed through the faceplate 27. A novel contrast enhancing coating 37 is applied to an exterior surface 39 of the faceplate panel 27, to improve the contrast of the viewing images during the operation of the CRT 21.

The novel contrast enhancing coating improves the contrast of CRT 21 by decreasing the transmission of the faceplate 27 while maintaining a large gloss value. The contrast of a CRT 21 is essentially the ratio of the signal of the view image of the CRT 21 to the noise. The noise is the ambient signal from the area surrounding the CRT 21 that reflects off of the faceplate. The contrast is often characterized by the following expression:

$$C = \frac{t \times L}{(t^2 \times A) + (\vartheta \times A)}$$

where C is the contrast, t is the transmission, L is the luminance of the CRT in foot-lamberts in the English system, θ is the Fresnel reflection at the glass-air interface, and A is the ambient illuminance in foot-candles in the English system. In environments with high ambient signal, it is preferred to have lower transmissions. Values at about 40% have been deemed desirable. In short, it is desirable to have a high contrast. Regarding gloss, it is recognized that high values of gloss are preferred to lower values because as gloss diminishes, the scatter of the image signal light exiting the faceplate 27 increases, thereby distorting the visual image.

The manufacture of the CRT with the novel contrast enhancing coating begins with the preparation of an intermediate formulation which starts by hydrolyzing an organic silicate in a mixture of an alcohol, an acid and water. A final solution is then prepared by diluting the intermediate formulation with an organic solvent and adding contrast enhancing material.

In the first example, the specific materials and their respective masses used for the preparation of the formulations are as follows:

the organic silicate is tetraethyl orthosilicate at 50–90 g;

the alcohol is ethanol at 45 g;

the acid is concentrated hydrochloric acid at 1 g;

water is used at 670 g;

the solvent is acetone at 300 g; and the contrast enhancing material is the neutral density material Levanyl Black at 4–9 g, with the preferred value at 5 g.

The preparation of the final formulation first involves rolling 5 g of Levanyl Black in about 572 g of water. Levanyl Black is available from the Bayer Company. In a separate vessel the organic silicate, the acid, the alcohol, and some water are mixed. The contents of the separate vessel are shaken to hydrolyze the organic silicate, thereby creating an intermediate silicate formulation. The solvent and remaining water are then mixed into the separate vessel, thereby making a diluted intermediate silicate formulation. This diluted intermediate silicate formulation is then mixed with the rolled Levanyl Black mixture, thereby yielding a final formulation.

The final formulation is then sprayed onto the exterior surface 39 to form the contrast enhancing coating 37. During the spraying step, it is preferred to have the faceplate 27 heated to 27–30° C. After spraying, the faceplate 27 should then be heated by some suitable means such as an IR heater to cure the coating, wherein the preferred temperature is 80–100° C. The coating 37 is then rinsed with water. It is important to note that after curing practically no release of the contrast enhancing material occurs. The resultant gloss value in this first example is about 70 with the surface finish having a somewhat grainy appearance.

In the second example, and a more preferred embodiment with respect to yielding higher gloss, the specific materials and the respective masses used for the preparation of the formulations are as follows:

the organic silicate is tetraethyl orthosilicate at 50–90 g, with the preferred value at 75 g;

the alcohol is ethanol at 45 g;

the acid is concentrated nitric acid at 1 g in 20 g of water;

water is used at 1752 g;

the solvent is 1-propanol at 1260 g; and the contrast enhancing materials are Levanyl Black at 5–8 g (pigment) and Nigrosin Black (black die from Aldrich Co.) at 2–3 g.

The preparation of the Levanyl Black involves rolling 5 g of Levanyl Black in about 572 g of water and the preparation of the Nigrosin Black involves rolling 2–3 g of the Nigrosin Black in about 420 g of water. The Nigrosin Black solution should have a pH of 3.0–6.0 which can be obtained with the addition of an appropriate quantity of 10% nitric acid after the Nigrosin Black is rolled. In this example, the order of ingredients is particularly important for obtaining a stable formulation. Experiments have shown that an intermediate silicate formulation should be made in a separate vessel by first adding the acid to about 20 g of water followed by the addition of the alcohol and organic silicate. Next, the contents of the separate vessel should be shaken to hydrolyze the organic silicate, thereby creating the intermediate silicate formulation. The solvent and remaining water should then be mixed into the separate vessel, thereby making a diluted intermediate silicate formulation. The general conclusion is that it is best to dilute the intermediate formulation with a slow evaporating organic solvent such as 1-propanol and water. The reason is that the final formulation will flash-off more slowly during application and, in turn, provide a glossier finish.

Levanyl Black and then the Nigrosin Black are added to the diluted intermediate formulation, thereby making the final formulation. The final formulation is then sprayed onto the exterior surface 39 to form the contrast enhancing coating 37. During the spraying step, it is preferred to have the faceplate 27 heated to 27–30° C. After spraying, the faceplate 27 should then be heated by some suitable means such as an IR heater to cure the coating, wherein the preferred temperature is 80–100° C. The coating 37 is then rinsed with water. It is important to note that after curing no release of the contrast enhancing material occurs. The resultant 60° gloss value in this example is about 90 with the surface finish having no grainy appearance.

Figure 3:
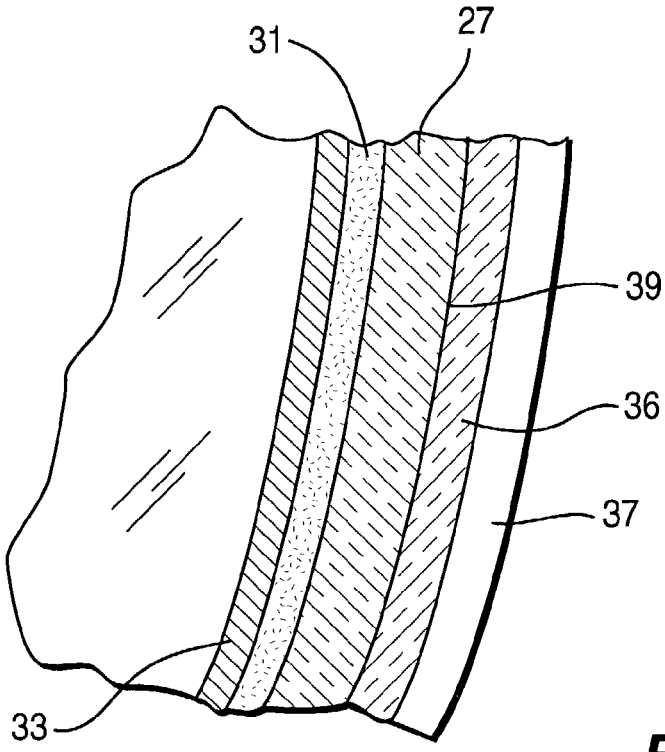
FIG. 3 is an enlarged sectional view of another embodiment of the invention through a fragment of the faceplate of the tube.

Other embodiments of the invention include the application of a conductive layer 36 onto the exterior surface 39 before the application of the contrast enhancing coating 37 as shown in FIG. 3. An example of how such a layer 36 can be applied involves first preparing an aqueous formulation having 5% Baytron Al 4071 by weight and 0.5% hydrolyzed tetraethylorthosilicate. Baytron Al 4071 is available from the Bayer Corp. Next the formulation can be applied to the exterior surface 39 of the faceplate 27 while the faceplate 27 is at room temperature or slightly thereabove. Multiple layers of the conductive layer 36 can be applied to achieve the desired conductance.

The examples described above have yielded CRTs 21 having gloss measurements from about 70 to about 90 while substantially reducing the transmission of the faceplates 27 from about 80 to 40%. The gloss measurement technique substantially conforms to the US Standard ASTM D 523 or US Standard ASTM D 2457 at 60°.

It can be appreciated by those skilled in the art that the spirit of this invention provides other effective embodiments. For example, other contrast enhancing materials such as Sudan Black (from Bayer AG) have been efficacious. Further, carbon black materials having particles sizes wherein particles ranging from 35 to 170 nm are also effective.

What is claimed is:

1. A CRT comprising a funnel having a neck attached to the narrow end of said funnel, an electron gun mounted in said neck, a viewing faceplate attached to a wide end of said funnel and having a luminescent screen on an interior surface of said faceplate, and a contrast enhancing coating on an exterior side of said viewing faceplate, wherein said contrast enhancing coating comprises a silicate binder and at least one contrast enhancing material, said contrast enhancing coating having both transmission reduction of visible light by about 50% and having a 60° gloss value of at least 70 to 90.

2. The CRT according to claim 1 wherein said contrast enhancing coating is in intimate contact wit an exterior surface of said faceplate.

3. The CRT according to claim 1 wherein said silicate binder is derived from an organic silicate binder.

4. The CTR according to claim 1 wherein said organic silicate binder is tetraethyl orthosilicate.

5. The CRT according to claim 1 wherein said contrast enhancing material is a black pigment, said black pigment comprising at least one material.

6. The CRT according to claim 5 wherein said black pigment comprises carbon black particles having particles in the range 35 to 170 nm.

7. The CRT according to claim 1 wherein a mass ratio of said silicate binder to said contrast enhancing material is 9–11:1.

8. The CRT according to claim 1 wherein at least one conductive layer is between an exterior surface of said faceplate and said contrast enhancing coating, wherein at least one conductive layer comprises an organic conductive material and a silicate.

* * * * *